United States Patent [19]

Hillinger et al.

[11] Patent Number: 4,684,374

[45] Date of Patent: Aug. 4, 1987

[54] METHOD FOR THE CONTINUOUS GASIFICATION OF SOLID FUEL

[75] Inventors: Bruno Hillinger, Hinterbrühl; Georg Beckmann, Vienna, both of Austria

[73] Assignee: Waagner-Biro Aktiengesellschaft, Austria

[21] Appl. No.: 931,850

[22] Filed: Nov. 18, 1986

Related U.S. Application Data

[63] Continuation of Ser. No. 681,326, Dec. 13. 1984, abandoned.

[30] Foreign Application Priority Data

Dec. 20, 1983 [AT] Austria ..... 4448/83

[51] Int. Cl.[4] ..... C10J 3/16

[52] U.S. Cl. ..... 48/197 R; 48/202; 48/203; 48/209

[58] Field of Search ..... 48/202, 203, 206, 210, 48/197 R, 209, DIG. 1, DIG. 7; 34/39, 40

[56] References Cited

U.S. PATENT DOCUMENTS

| | | | |
|---|---|---|---|
| 217,273 | 7/1879 | Dowling | 34/40 |
| 795,874 | 8/1905 | Whitfield | 48/DIG. 1 |
| 887,058 | 5/1908 | Bauke | 48/202 |
| 1,189,638 | 7/1916 | Testrup et al. | 48/209 |
| 4,244,706 | 1/1981 | Forney et al. | 48/206 |
| 4,280,415 | 7/1981 | Wirguim et al. | 34/40 |

*Primary Examiner*—Peter Kratz

*Attorney, Agent, or Firm*—Steinberg & Raskin

[57] ABSTRACT

Method for the continuous gasification of solid carbonaceous fuel, especially fuel having a high water content such as biomass and brown coal, in which the fuel is indirectly heated by condensing steam. Steam removed from the fuel during drying is then utilized to aid in the gasification of the same, thus producing generator gas, which is directly recovered.

5 Claims, 1 Drawing Figure

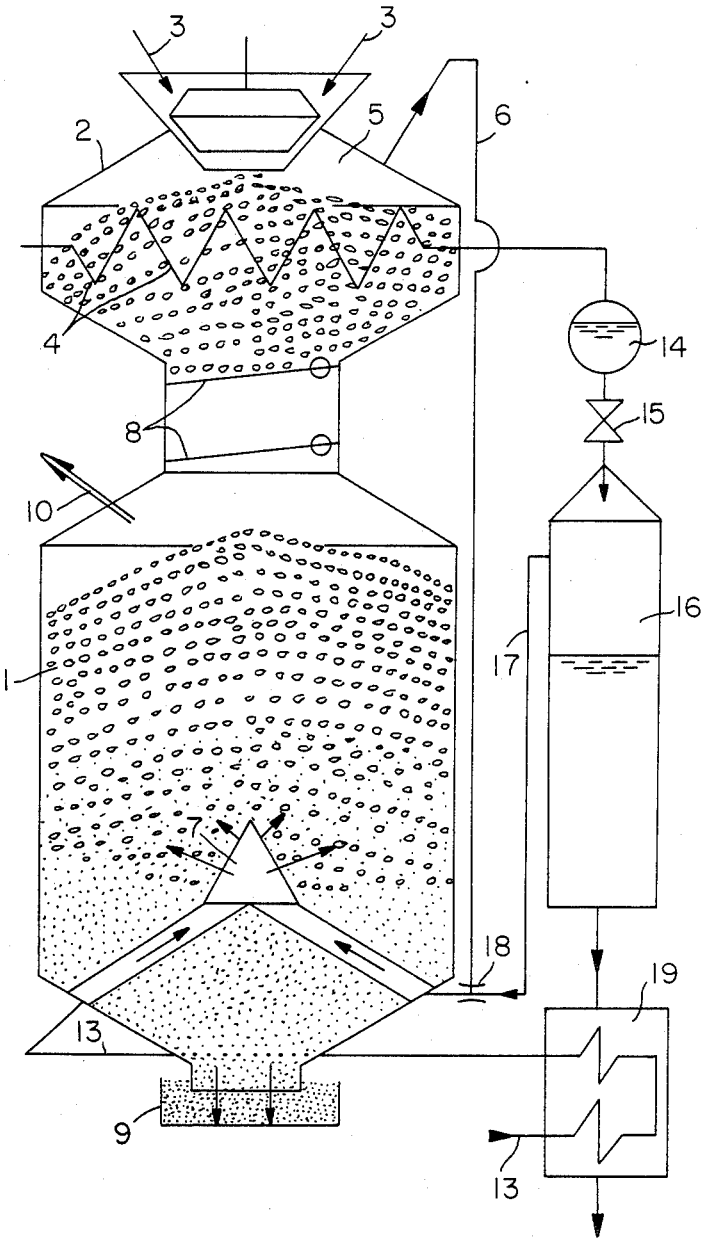
3
3
2
5
6
4
14
15
8
10
16
17
1
7
18
19
13
9
13

METHOD FOR THE CONTINUOUS GASIFICATION OF SOLID FUEL

This is a continuation of application Ser. No. 681,326 filed Dec. 13, 1984, now abandoned.

BACKGROUND OF THE INVENTION

The present invention relates to a method and apparatus for the continuous gasification of solid fuel. More particularly, the present invention relates to a method and apparatus for continuous gasification of solid fuel having a high water content, such as biomass or raw brown coal, in a countercurrent. Such fuel having a high water content is dried, heated, and ultimately gasified in a glowing fuel bed. Steam liberated from the fuel during the drying thereof is reduced at the glowing fuel bed during gasification of the fuel, with hot generator gas thereby being formed during the gasification. The thus-formed hot generator gas is supplied to a user, e.g. in the form of hot gas itself.

It has been known to gasify fuel and utilize, at the same time, the steam liberated during the drying of such fuel as gasification medium, to obtain generator gas. Generator gas contains condensable matter, and for this reason such generator gas is either combusted, uncooled, or purified by cleaning prior to combustion thereof, during which a loss of heat occurs. The condensable components are combustible (phenols, tar), and, in part, non-combustible (steam).

In order to increase the calorific value of the generator gas, it has been known to dry the fuel, prior to gasification thereof, with a portion of the hot generator gas so formed during gasification, and also to utilize the water content of the generator gas by injecting the fuel into the glowing fuel bed. However, part of the generator gas is lost during this process, since this portion of the generator gas is subjected to chemical change when passing through the glowing fuel bed.

SUMMARY OF THE INVENTION

Accordingly, it is an object of the present invention to eliminate the afore-mentioned disadvantages, in the gasification of fuel.

It is also an object of the present invention to improve gasification of fuel having a high water content.

It is another object of the present invention to improve efficiency of energy utilization during the gasification of fuel.

It is a further object of the present invention to increase the calorific value of gas generated during the gasification of fuel.

It is still another object of the present invention to reduce nitrogen content of the generator gas so produced during the gasification of fuel.

It is still a further object of the present invention to provide for successful, efficient gasification of a wider range of types of fuel than previously possible.

With the above objects in view, the present invention mainly comprises drying of the fuel to be gasified by indirect heating, especially in a vibrating dryer, with steam liberated during the drying of such fuel being exhausted from the dryer and then blown directly into the glowing fuel bed during gasification of such fuel.

The present invention is directed to a method for the continuous gasification of solid carbonaceous fuel having a high water content, such as the biomass and brown coal, in which such fuel is initially subjected to indirect drying in a heated drier that is heated by steam. The fuel does not contact the heating steam, while the fuel itself is heated and dried by steam being liberated or removed therefrom. The thus-heated and dried fuel is then passed from the drier into a gasification chamber, where the ultimate gasification of the fuel takes place to produce the generator gas.

The steam removed from the fuel during the drying thereof is then passed, along with an oxygen-containing gas such as air, through the heated, dried fuel within the gasification chamber, so that generator gas is formed from the heated and dried fuel, the steam liberated and removed during the drying of the fuel, and from the oxygen-containing gas. The thus-formed generator gas is directly recovered from within the gasification chamber. In a preferred embodiment, this generator gas is directly recovered by being drawn off from within the gasification chamber before the generator gas has a chance to reach the drier.

The present invention is also directed to an apparatus for the continuous gasification of solid carbonaceous fuel having a high water content, which comprises a heated drier for subjecting the fuel to indirect drying by steam, and a gasification chamber communicating with the drier, for forming generator gas from the fuel. Conduit means are also provided for introducing the oxygencontaining gas into the gasification chamber, and for exhausting the steam liberated during the drying of the fuel within the drier and directing the same into the gasification chamber.

Conduit means are also provided for passing the heating and drying steam through the drier to indirectly heat and dry the fuel therein by removing steam therefrom, with a sealing arrangement disposed between the communicating drier and gasification chamber. This sealing arrangement is adapted to open in order to allow passage of heated and dried fuel from the drier into the gasification chamber, for the gasification of the same to produce generator gas.

Removal means are also provided in the apparatus of the present invention for directly removing the thus-formed generator gas from within the gasification chamber. In a preferred embodiment, this removal means is constituted by an exhaust opening in the gasification chamber, so that the thus-formed generator gas can be drawn off from within the chamber before reaching the drier. The oxygen-containing gas and the steam liberated and removed from the fuel in the drier, may be introduced into the gasification chamber through a gas distributor.

Thus the gasification efficiency of the dried fuel, to produce hot generator gas within the gasification chamber, is greatly improved due to the fact that the fuel is indirectly dried within the drier by condensing steam. The condensate of such condensing steam is then pressure-reduced to create resulting low-pressure or booster steam. This low-pressure or booster steam can then be utilized to draw off steam liberated from the fuel dried within the drier, and to direct the same into the gasification chamber, where the ultimate mixture of both types of steam, i.e. the low-pressure booster steam and the liberated steam from the drying fuel, is used as an oxidation medium for the carbon glowing in the fuel bed within the gasification chamber.

The resulting generator gas produced within the gasification chamber may be supplied to a user in the form of hot gas. Consequently, the nitrogen gas, $N_2$, content of the generator gas is reduced, and the calorific value thereof is thus increased. The present invention is especially advantageous for gasifying highly aqueous fuels. Accordingly, it is now possible to successfully, efficiently gasify wider range of fuels, with the present invention.

BRIEF DESCRIPTION OF THE DRAWINGS

The present invention will be further described in greater detail with reference to the accompanying drawing, in which:

FIG. 1 is a schematic illustration of an embodiment of the present invention.

DETAILED DESCRIPTION OF THE PREFERRED EMBODIMENTS

Referring to FIG. 1, an apparatus for gasification according to the present invention is illustrated, having a gasification chamber 1, and a drier 2. The fuel to be gasified, such as biomass or raw brown coal, is fed into the drier 2 in the direction of the illustrated arrows 3, and heated along the heat exchange walls 4, which, if necessary, can be vibrated to improve thorough mixing of the fuel within the drier 2. During the heating of the fuel within the drier 2, the fuel is dried by removal of steam therefrom.

This resulting steam which is removed or liberated from the drying fuel, collects in the upper head space 5 of the drier 2 above the level of the fuel filled within the drier 2. This resulting liberated steam is then fed from the head space 5 of the drier 2 through a steam conduit 6 and into the gasification chamber 1. The feeding of the liberated steam from within the drier 2 and into the gasification chamber 1 occurs together with the feeding of the required oxygen-containing gas 13 such as air through the gas distributor 7.

After having been sufficiently heated and dried, the fuel is then transferred in a virtually oxygen-free condition through a sealing arrangement 8 and into the gasification chamber 1 itself. Within the gasification chamber, the dried fuel is heated by the rising hot gases to above 200° C., so that the fuel decomposes. The ash residue is removed through the ash pan 9, while the hot generator gas exits from the gasification chamber through the exhaust 10.

The gasification virtually occurs in three zones within the gasification chamber. In the lower zone, carbon is burned to $CO_2$ due to the generation of heat. In the subsequent zone, which is situated slightly above the lowest zone and has a temperature of about 1000° C., the $CO_2$ generated within the lower zone is transformed into CO by the glowing carbon. At the same time, the steam flowing through the glowing fuel bed is subjected to the water-gas reaction at the glowing carbon, thus generating CO—$H_2$ gas.

A low-temperature carbonization of the fuel preheated in the drier 2 occurs in the above-situated third zone, while apart from high-grade hydrocarbons, tars, $H_2$, ammonia, hydrogen sulfide, and other compounds are also liberated. This transformation of gases illustrates that, when using air as an oxygen carrier, the generator gas will contain a large quantity of non-combustible nitrogen. The oxygen contained in the air is transformed into CO, while the $N_2$ dilutes the combustible gas, so that its calorific value is not especially high.

The nitrogen content will decrease in proportion to the consumption of air, while hydrogen and CO will be generated, only after injection of steam into the gasification chamber instead of a portion of the oxygen containing gas or air. In order to prevent a loss of heat, the generator gas is ultimately combusted as hot as possible, i.e. with the condensable components therein.

If the generator gas flows through the drier 2 by the known prior art method, this will produce a reduction in the temperature of the generator gas, and part of the condensable substances, such as pitch and tar, will be condensed at the fuel which is to be dried, so that the generator gas could be handled with greater ease. Also, during the injection of the steam-containing generator gas into the fuel bed, the generator gas, especially its hydrocarbon compounds content from the low-temperature zone, is transformed into CO and $H_2$, with a loss of calorific value consequently occurring. As the steam of the generator gas liberated during drying is further diluted, a further loss in the calorific value will occur. This loss can be prevented by drawing off the generator gas before the gas reaches the drier 2, and ultimately supplying such generator gas to a user.

Condensing steam at a temperature of about 200° C. and at a pressure of 10 to 30 ata passes through the drier 2 in coiled pipes or along the installed heating walls 4, in order to indirectly heat and dry the fuel contained within the drier 2. The condensate formed from the condensing steam, within the coils or pipes for example, is collected in a condensate collector 14. The pressure of such collected condensate is then reduced at a shut-off spot 15, whereupon low-pressure booster steam and evaporated condensate form in the pressure reduction/-steam generator 16.

This generated steam is then blown into the gasification chamber 1 through a steam pipe 17, while flowing through an ejector 18 which may be driven by the steam generated within the pressure reduction/steam generator 16. The steam generated within the drier 2, being liberated or removed from the fuel being dried therein, is drawn through the steam pipe or conduit 6 and mixed with the low-pressure steam produced within the pressure reduction/steam generator 16 (the ejector 18, provided in the steam pipe 17, is connected at its suction side with the head space 5 of the drier 2 through the steam conduit 6, as illustrated in FIG. 1).

The condensate from the pressure reduction/steam generator 16 is then cooled in a condensate super-cooler 19, with at least part of the super-cooling heat being exhausted or passed to the oxygen-containing gas 13 such as air required for the operation of gasification within the gasification chamber 1 (i.e. the super-cooler 19 is connected with the pipe in-feeding the air 13 into the gasification chamber, as illustrated in FIG. 1).

The preceding description of the present invention is merely exemplary, and is not intended to limit the scope thereof in any way.

What is claimed is:

1. Method for the continuous gasification of solid carbonaceous fuel having a high water content, such as biomass and brown coal, comprising the steps of subjecting said fuel to drying in a heated drier by indirect heat exchange with condensing heating steam with attendant condensation of the heating steam into a condensate and removal of water as steam from said fuel, whereby said fuel does not contact the heating steam, passing the thus-heated and dried fuel into a gasification chamber separated from the drier and the fuel contained in the drier to form a fuel bed in the gasification chamber, recovering the condensate after the same has heated said fuel, reducing the pressure of the recovered condensate to generate low-pressure steam, mixing at least a portion of the thus-generated low-pressure steam with the steam removed from said fuel to obtain a steam mixture, introducing the thus-obtained steam mixture and an oxygen-containing gas into said bed of heated and dried fuel in said gasification chamber, whereby hot generator gas is formed in a glowing region of said fuel bed from said heated and dried fuel, said removed steam, and said oxygen-containing gas, and directly removing the thus-formed generator gas from said gasification chamber for consumption while still in its hot state, while bypassing said drier, whereby the generator gas is prevented from entering the drier and becoming mixed with said steam removed from said fuel.

2. The method of claim 1 wherein the heating steam is supplied at a pressure of 10 to 30 ata.

3. The method of claim 1, wherein said mixing step includes using the low-temperature steam in an ejector for withdrawing said steam removed from said fuel from said drier prior to introduction of the steam mixture into said gasification chamber.

4. The method of claim 1, additionally comprising the steps of super-cooling condensate remaining after the pressure reduction of the heating steam condensate, and utilizing heat released during said super-cooling to heat the oxygen-containing gas prior to introduction of the same into said gasification chamber.

5. The method of claim 1, additionally comprising the steps of vibrating said fuel during the drying thereof.

* * * * *